United States Patent [19]

Brucato

[11] Patent Number: 4,609,432

[45] Date of Patent: Sep. 2, 1986

[54] METHOD OF MAKING PAPER HAVING IMPROVED TEARING STRENGTH

[75] Inventor: Albert Brucato, Seattle, Wash.

[73] Assignee: Brooks Rand Ltd., Seattle, Wash.

[21] Appl. No.: 621,139

[22] Filed: Jun. 15, 1984

Related U.S. Application Data

[63] Continuation-in-part of Ser. No. 410,434, Aug. 23, 1982, abandoned, which is a continuation-in-part of Ser. No. 265,811, May 21, 1981, Pat. No. 4,347,100.

[51] Int. Cl.[4] ..... D21H 5/12

[52] U.S. Cl. ..... 162/141; 162/149; 162/168.1; 162/169; 162/175; 162/182; 162/183

[58] Field of Search ..... 162/141, 149, 164.5, 162/175, 183, 182, 164.6, 168.1, 169

[56] References Cited

U.S. PATENT DOCUMENTS

| | | | |
|---|---|---|---|
| 2,765,229 | 10/1956 | McLaughlin | 92/21 |
| 2,998,344 | 8/1961 | Carlson | 162/175 |
| 3,151,017 | 9/1964 | Brafford | 162/141 |
| 3,194,727 | 7/1965 | Adams et al. | 162/168 |
| 3,325,346 | 6/1967 | Osborg | 162/164 |
| 3,436,305 | 4/1969 | Maher | 162/175 |
| 4,210,488 | 7/1980 | Reuss et al. | 162/183 |
| 4,269,657 | 5/1981 | Gomez et al. | 162/135 |
| 4,309,247 | 1/1982 | Hou et al. | 162/149 |

FOREIGN PATENT DOCUMENTS 764147 12/1956 United Kingdom .

OTHER PUBLICATIONS

Gupta, M. K., TAPPI, Mar. 1980, vol. 63, No. 3, pp. 29–31.

*Primary Examiner*—Peter Chin

*Attorney, Agent, or Firm*—Marshall, O'Toole, Gerstein, Murray & Bicknell

[57] ABSTRACT

The tearing strength of paper is improved by providing a furnish in which the fiber content is predominantly refined fiber with a minor amount, preferably 2 to 10 wt. %, of added unrefined fiber having incorporated therein a heat activatable bonding agent, particularly starch. The bonding agent adheres to and coats the added fiber without chemically reacting with the fiber. A cationic material, particularly polyethyleneimine, is premixed with the raw starch to cause it to adhere to the added fiber. During heat drying of the formed paper the starch is gelatinized to effect enhanced bonding of the added fiber.

28 Claims, No Drawings

METHOD OF MAKING PAPER HAVING IMPROVED TEARING STRENGTH

This application is a continuation-in-part of my copending application Ser. No. 410,434, filed Aug. 23, 1982, abandoned which is in turn a continuation-in-part of my prior application Ser. No. 265,811, filed May 21, 1981, now U.S. Pat. No. 4,347,100, issued Aug. 31, 1982.

This invention relates to a method of making paper having improved tearing strength.

BACKGROUND OF THE INVENTION

Paper may be viewed as a network of cellulosic fibers that are bonded together at those areas where the fibers come in contact with one another. As the bonded areas are made closer to one another, each fiber will have correspondingly less unbonded area. This situation may be brought about by the customary beating or refining techniques that shorten the fibers, increase their surface area, and make them more flexible or pliable while wet. If the fiber network is made up mostly of bonded areas, it may be expected to be less flexible than a network of fibers that has mostly unbonded areas.

It is well known that generally as the extent of fiber refining is increased, the tensile strength and bursting strength of the ultimately formed paper may increase but the tearing strength will decrease. In other words, a paper whose fibers are well bonded as a result of a high degree of refining of the pulp will have greater tensile strength and bursting strength than a paper having only moderately bonded fibers but it will be less resistant to tear. The well bonded paper transmits applied stress directly to the propagation point of a tear so that the paper tears more easily. On the other hand, a moderately bonded paper will tend to distribute the applied stress to areas adjacent to the tear propagation point as well as to the propagation point so that it has more resistance to tear. The papermaker is therefore faced with the choice of refining the fiber more so as to improve its tensile and bursting strengths or refining it less so as to retain as much resistance to tear as possible.

SUMMARY OF THE INVENTION

As described above, the art recognizes that as the degree of fiber refining is increased, the tensile strength of the paper also increases but the tearing strength decreases so that often a compromise must be made. However, this relationship has been observed under the normal papermaking circumstances in which it may be presumed that the fiber bonds are of approximately equal strength, that the bonds are uniformly distributed throughout the paper, and that the paper is made of essentially like fibers. Broadly speaking, in accordance with the present invention, a greater tearing strength is achieved by reversing these presumptions, i.e. by introducing some fiber bonds of a different strength from those usually in the paper, by distributing such bonds non-uniformly, and by introducing some fibers that are unlike those usually in the paper.

As described more specifically hereinafter, the invention achieves a difference in bond strength by providing a major portion of principal fiber and adding a minor portion of a fiber having the ability to form stronger bonds with the principal fiber or itself than the principal fiber can with itself. Preferably, this increased bond strength is accomplished by pretreating the added fiber with a heat activatable bonding agent that adheres to and coats the added fiber without chemically reacting with it and becomes effective during the heat drying stage of the papermaking process. The added fiber preferably is unrefined or has a grossly lesser degree of refining than the principal fiber. Non-uniform distribution of the added fiber is achieved on a microscale by admixing only a small percentage of added fiber with the principal fiber in preparing the furnish to be supplied to the papermaking machine.

As a result of these steps, a well bonded paper made in accordance with the invention will still have good tensile strength and be less flexible, but when under tearing stress, the weaker bonded areas will come apart first and thus activate the latent network of stronger bonds that are more spaced than the weaker bonds. These stronger bonds are thus able to disperse the stress away from the tear propagation point and so result in greater resistance to tear.

Accordingly, a primary object of the present invention is to provide a method of making paper having improved tearing strength while at the same time avoiding loss of tensile strength to any detrimental extent.

A further object of the invention is to provide a method of making paper having an improved combination of strength properties by introducing fiber bonds of unequal strength and distributing them non-uniformly throughout the paper.

Another object of the invention is to provide a novel and improved method of utilizing a heat activatable bonding agent to improve the tearing strength of paper.

Other objects and advantages of the invention will be understood from the subsequent detailed description.

DETAILED DESCRIPTION

It has been known for many years in the papermaking art that paper made from well refined pulp is much more dense, hard, and strong. While it is generally true that an increased degree of pulp refining results in higher tensile strength and bursting strength of the paper, unfortunately the tearing strength or internal tearing resistance is generally decreased. Accordingly, in cases where tearing strength is an important property of the paper, the papermaker must ordinarily utilize a degree of refining of the pulp that results in a compromise between tensile strength and tearing strength. Various additives have also been used in the pulp refining stage to enhance fiber-to-fiber bonding, but the customary usage of such additives does not always result in the improvement of the tearing strength of the paper without adversely afffecting other desired properties of the paper.

In accordance with the present invention, a relatively coarse fiber network is caused to be interposed within and bonded to the normal relatively fine fiber network of the paper so that the random fiber distribution is uniform on a macroscale but is non-uniform on a microscale. The coarser fiber network is well bonded and preferably is made of longer and stronger fibers. The effect of this non-uniform distribution on a microscale is to increase the tearing strength or resistance to internal tear. By the presence of interspersed longer and stronger fibers in the matrix of the sheet, an applied tearing stress is distributed by the longer fibers to an area around the moving point of tear propagation rather than permitting the stress to concentrate at the propagation point. The finer fibers and their interfiber bonds rupture more easily when stressed, and thus the stress is taken up to a greater degree by the longer fibers that extend away from the propagation point so as to distribute the stress to a larger area of the sheet.

The present invention achieves this desirable result by preparing a furnish in which the fiber content is predominantly relatively fine principal fiber with a minor amount of added fiber that has been pretreated with a heat activatable fiber bonding agent. Although the added fiber may have the same degree of refining as the principal fiber, it is generally preferred to use an added fiber that is unrefined or has a substantially lesser degree of refining than the principal fiber so as to take maximum advantage of the mechanical phenomenon described above in which the longer and stronger fibers of unrefined pulp distribute tearing stress away from the point of tear propagation.

From a practical standpoint, starch is the most economical and effective fiber bonding agent, but it can be expected that polyvinylchloride resins, acrylic resins, polyurethane resins, and other heat activatable resinous materials may also be suitable. The bonding agent physically or mechanically adheres to the added fiber so as to provide chemically unreacted fiber that is coated with the bonding agent. In the case of starch, it is also desirable to utilize a cationic material capable of causing the starch to adhere to the added fibers. The polyethyleneimines (e.g. CHEMICAT P-145 by Chemirad Corporation) have been found particularly useful for this purpose, but other cationic organic polyelectrolytes or polymers may also be used, including polyamide-polyamine resins (e.g. KYMENE 557H by Hercules, Incorporated), urea-formaldehyde resins (e.g. PAREX 615 by American Cyanamid Co.), melamine-formaldehyde resins (e.g. PAREX 607 by American Cyanamid Co.), and polyacrylamides (e.g. SEPARAN CP7 by Dow Chemical Co.).

When a heat activatable resinous material is used as the fiber bonding agent, it will be possible in some instances to obtain such resins in cationic form, in which case it may not be necessary to utilize an added cationic material to cause adherence of the bonding agent to the fibers.

In practicing the invention, a first aqueous slurry of the principal fiber is provided utilizing a pulp that has been refined to the extent necessary to achieve the desired tensile strength and other properties of the paper that are dependent upon a selected degree of refining. A second aqueous slurry of the added fiber is also provided, and in accordance with the preferred embodiment of the invention, the second slurry utilizes a pulp that is the same as or different from the pulp of the first slurry but preferably is unrefined or only slightly refined as compared with the pulp of the first slurry. The fiber bonding agent is incorporated in the second slurry. For example, uncooked dry starch is premixed with an aqueous solution of polyethyleneimine, and the premixture is then added to the second slurry. The starch particles coated with the cationic agent are attracted to and adhere to the added fiber of the second slurry. A relatively minor predetermined amount of the second slurry is then added to and mixed with a major predetermined amount of the first slurry containing the principal fiber. The resultant furnish is then supplied to the papermaking machine where it is formed into a sheet and heat dried in the usual manner. The added fibers coated with starch are distributed non-uniformly throughout the sheet on a microscale, as previously explained, and during heat drying the starch is gelatinized in situ in the sheet in order to achieve the desired stronger bonding effect. In the case of a heat activatable resinous bonding agent, the heat drying step causes the resinous material to soften, thereby effecting the desired bonding. The result is a significant increase in tearing strength of the paper, e.g. as much as about 25%, without any detrimental loss of tensile strength and other desired properties.

In accordance with the fiber mechanics of the present invention, only a very small amount of added fiber is required to achieve a significant improvement in tearing strength, and there appears to be no benefit in using excessive amounts of the added fiber. In general, the amount of added fiber may comprise from about 2% to about 10% by weight of the total fiber content of the furnish. The amount of bonding agent to be incorporated in the added fiber may vary within wide limits. Although increasing the amount of bonding agent results generally in greater improvement in tearing strength of the paper, economic considerations will generally place a practical limit upon the amount of bonding agent that can be used. In the case of starch, for example, effective results are obtained using raw starch in an amount of from about 20 to about 200% by weight of the added fiber content. The amount of cationic material to be used may also vary depending upon the surface area of the added fiber, but in general only a minor amount of cationic agent is required to achieve the desired effect. For example, when starch is used as the bonding agent, the amount of cationic agent such as polyethyleneimine may be from about 0.01 to about 0.1% by weight of the added fiber.

For purposes of the further illustrating the invention, but not by way of limitation, the following specific examples are presented.

EXAMPLES

A series of laboratory tests were conducted using unbleached kraft pulp made from hemlock and Douglas fir wood. The unrefined fiber had a freeness of 730 CSF. A portion of this pulp was refined in a Valley beater to a freeness of 312 CSF.

The bonding agent used in the test program was unmodified or raw cornstarch designated as Corn Products Starch 3005 (Corn Products, CPC International). The cationic material used was polyethyleneimine water soluble resin having a molecular weight of 50,000 to 60,000 designated as Chemicat P-145 (Chemirad Corporation).

In the tests that were made to evaluate the present invention, the following procedure was followed. An aqueous solution of polyethyleneimine was added to the dry, uncooked, raw starch and stirred to obtain a uniform heavy paste. This paste was then added to a small portion of fiber slurry, either refined or unrefined, and the mixture was stirred for uniform distribution. Microscopic examination of the fibers at this stage confirmed that the starch was deposited on the fibers. A small portion of this starch-fiber slurry was then added to a much larger portion of refined fiber slurry and stirred for uniformity to provide the furnish. This furnish was then made into handsheets with a 3 gram target weight equivalent to a basis weight of approximately 80 g/m$^2$ on an oven dry basis. The drying of the handsheets was carried out using a Williams hot plate. In some instances the drying was accomplished simply by holding the wet sheet in contact with the heated surface of the hot plate using a taut cloth. In other cases a piece of plastic sheet was placed over the taut cloth for the first 30 seconds of the drying step so as to retain the steam for that amount of time, thereby giving the starch an increased opportunity for steam cooking in situ.

For control purposes, tests were also run using only the refined fiber, only the unrefined fiber, and mixtures of the two without utilizing the starch or polyethyleneimine.

In each case the handsheets were tested for tearing strength using an Elmendorf instrument according to TAPPI method T-414. The samples were cut to a specified size and conditioned in a room at 50% relative humidity and 23° C. for at least 24 hours prior to tear testing. In order to compensate for variations in handsheet weight, the tear test results are reported as Tear Factor in accordance with the following formula:

$$\text{Tear Factor} = \frac{\text{Average Of 3 Readings} \times 1600}{\text{No. of Plies} \times \text{o.d. Basis Wt. (g/m}^2\text{)}}$$

The test data are set forth in the following table:

| RUN NO | PRINCIPAL FIBER WT. % | ADDED FIBER WT. % | STARCH WT. % | PEI WT. % | TEAR FACTOR |
|---|---|---|---|---|---|
| 1 | 100 U | — | 0 | 0 | 160 |
| 2 | 100 R | — | 0 | 0 | 113 |
| 3 | 98 R | 2 U | 0 | 0 | 141 |
| 4 | 95 R | 5 U | 0 | 0 | 127 |
| 5 | 90 R | 10 U | 0 | 0 | 136 |
| 6 | 98 R | 2 U | 20 | .010 | 129 |
| 7 | 95 R | 5 U | 20 | .012 | 126 |
| 8 | 90 R | 10 U | 20 | .010 | 138 |
| 9 | 98 R | 2 R | 20 | .020 | 128 |
| 10 | 95 R | 5 R | 20 | .023 | 122 |
| 11 | 90 R | 10 R | 20 | .020 | 129 |
| 12 | 98 R | 2 U | 50 | .025 | 127 |
| 13 | 95 R | 5 U | 50 | .025 | 129 |
| 14 | 98 R | 2 R | 50 | .057 | 130 |
| 15 | 95 R | 5 R | 50 | .042 | 132 |
| 16 | 95 R | 5 U | 100 | .050 | 137 |
| 17 | 95 R | 5 R | 100 | .080 | 133 |
| 18 | 95 R | 5 R | 150 | .033 | 136 |
| 19 | 95 R | 5 R | 200 | .042 | 141 |

U = Unrefined pulp
R = Refined pulp

A comparison of the controls in Runs 1 and 2 shows the expected higher tearing strength of paper made from unrefined pulp as compared with refined pulp. In Runs 3–5 the use of predominantly refined fiber plus a small portion of unrefined fiber shows a greatly improved tearing strength, compared with Run 2 using all refined fiber, and the increase is disproportionate to the small percentage of unrefined fiber in the furnish.

Runs 6–19 are in accordance with the present invention in which starch and polyethyleneimine were mixed with the added fiber prior to the incorporation of the added fiber into the principal fiber slurry. In Runs 6–8 the added fiber is unrefined fiber, and in Runs 9–11 the added fiber is refined fiber. In each case the amount of starch used was 20% of the weight of the added fiber. In Runs 6–8 the polyethyleneimine was used at about 0.01 wt. % of the added fiber, and in Runs 9–11 the polyethyleneimine was used at about 0.02 wt. % of the added fiber. In each case it will be seen that the tearing strength of the paper was appreciably greater than when using only refined fiber, as in Run 2.

Runs 12–19 show the effect of using increased amounts of starch. It will be evident that the improvement in tearing strength increases with an increase in the percentage of starch on the added fiber, whether the added fiber is refined or unrefined.

Although the invention has been described with particular reference to certain specific embodiments thereof, it is to be understood that various modifications and equivalents may be resorted to without departing from the scope of the invention as defined in the appended claims.

I claim:

1. A method of making paper having improved tearing strength by introducing fiber bonds of increased strength that are distributed non-uniformly on a microscale, said method comprising the steps of providing a first aqueous slurry of a refined cellulosic pulp comprising a principal fiber, providing a second aqueous slurry of a cellulosic pulp that comprises an added fiber and that is unrefined or that has a substantially lesser degree of refining than the pulp of said first slurry so that said added fiber is longer and stronger than said principal fiber, incorporating only in the second of said slurries a heat activatable fiber bonding agent that adheres to said added fiber to provide chemically unreacted fiber that is coated with said bonding agent, whereby said coated added fiber is capable of forming stronger bonds with the principal fiber or with itself than the principal fiber can form with itself, thereafter admixing a predetermined amount of said second slurry with a predetermined amount of said first slurry to provide a furnish in which the fiber content is predominantly said principal fiber with a minor amount of said added fiber coated with said bonding agent, and forming said furnish into a sheet and heat drying the sheet to activate said bonding agent and thereby effect enhanced bonding of said added fiber in the finished sheet, whereby said finished sheet comprises a relatively coarse network of said added fiber interposed within, and having bonds of increased strength with, a relatively fine network of said principal fiber, and said bonds of increased strength being distributed non-uniformly on a microscale, whereby a tearing stress applied to the sheet is dispersed by said added fiber around the moving point of tear propagation.

2. The process of claim 1 wherein said bonding agent is selected from the group consisting of uncooked starch and heat activatable resinous materials.

3. The process of claim 1 wherein said added fiber comprises from about 2% to about 10% by wt. of the total fiber content of said furnish.

4. The process of claim 1 wherein said bonding agent comprises uncooked starch that is admixed or coated with a cationic material capable of causing the starch to adhere to said added fiber.

5. The process of claim 4 wherein said cationic material comprises polyethyleneimine.

6. The process of claim 5 wherein a premixture is prepared by combining dry starch with aqueous polyethyleneimine and said premixture is added to said second slurry.

7. The process of claim 4 wherein the amount of starch is from about 20 to about 200% by wt. of said added fiber.

8. The process of claim 5 wherein the amount of polyethyleneimine is from about 0.01 to about 0.1% by wt. of said added fiber.

9. The process of claim 1 wherein said bonding agent comprises a heat activatable resinous material.

10. The process of claim 9 wherein said resinous material is in cationic form.

11. The process of claim 5 wherein the amount of starch is from about 20 to about 200% by wt. of said added fiber and the amount of polyethyleneimine is from 0.01 to about 0.1% by wt. of said added fiber.

12. The process of claim 1, wherein said bonding agent is admixed or coated with a cationic material capable of causing the bonding agent to adhere to said added fiber.

13. The process of claim 9 wherein said resinous material is selected from the group consisting of polyvinylchloride resins, acrylic resins, and polyurethane resins.

14. A paper sheet made in accordance with the method of claim 1.

15. A method of making paper having improved tearing strength by introducing fiber bonds of increased strength that are distributed non-uniformly on a microscale, said method comprising the steps of providing a furnish comprising an aqueous slurry of cellulosic pulp in which the fiber content is predominantly a refined principal fiber with a minor amount of an added fiber, said added fiber being unrefined or substantially less refined than said principal fiber whereby said added fiber is longer and stronger than said principal fiber, and only said added fiber being precoated with a heat activatable fiber bonding agent so that said added fiber is capable of forming stronger bonds with the principal fiber or with itself than the principal fiber can form with itself, and forming said furnish into a sheet and heat drying to activate said bonding agent and thereby effect enhanced bonding of said added fiber in the finished sheet, whereby said finished sheet comprises a relatively coarse network of said added fiber interposed within, and having bonds of increased strength with, a relatively fine network of said principal fiber, and said bonds of increased strength being distributed non-uniformly on a microscale, whereby a tearing stress applied to the sheet is dispersed by said added fiber around the moving point of tear propagation.

16. The process of claim 15 wherein said bonding agent is selected from the group consisting of uncooked starch and heat activatable resinous materials.

17. The process of claim 15 wherein said bonding agent is admixed or coated with a cationic material capable of causing the bonding agent to adhere to said added fiber.

18. The process of claim 15 wherein said added fiber comprises from about 2% to about 10% by wt. of the total fiber content of said furnish.

19. The process of claim 15 wherein said bonding agent comprises uncooked starch that is admixed or coated with a cationic material capable of causing the starch to adhere to said added fiber.

20. The process of claim 19 wherein said cationic material comprises polyethyleneimine.

21. The process of claim 20 wherein a premixture is prepared by combining dry starch with aqueous polyethyleneimine and said premixture is used to precoat said added fiber.

22. The process of claim 19 wherein the amount of starch is from about 20 to about 200% by wt. of said added fiber.

23. The process of claim 20 wherein the amount of polyethyleneimine is from about 0.01 to about 0.1% by wt. of said added fiber.

24. The processes of claim 19 wherein the amount of starch is from about 20 to about 200% by wt. of said added fiber and the amount of polyethyleneimine is from 0.01 to about 0.1% by wt. of said added fiber.

25. The process of claim 15 wherein said bonding agent comprises a heat activatable resinous material.

26. The process of claim 25 wherein said resinous material is in cationic form.

27. The process of claim 25 wherein said resinous material is selected from the group consisting of polyvinylchloride resins, acrylic resins, and polyurethane resins.

28. A paper sheet made in accordance with the method of claim 15.

* * * * *